United States Patent [19]

Busch

[11] 4,447,371

[45] May 8, 1984

[54] CARBURETOR

[76] Inventor: Frank R. Busch, 1062 W. Maple Ave., Wauconda, Ill. 60084

[21] Appl. No.: 390,069

[22] Filed: Jun. 18, 1982

[51] Int. Cl.[3] ..... F02M 7/22

[52] U.S. Cl. ..... 261/44 E; 261/53; 261/DIG. 56

[58] Field of Search ..... 261/44 F, 44 E, DIG. 56, 261/53

[56] References Cited

U.S. PATENT DOCUMENTS

| | | | |
|---|---|---|---|
| 791,447 | 6/1905 | Breath | 261/62 |
| 1,270,432 | 6/1918 | Monosmith | 261/44 |
| 1,428,558 | 9/1922 | Renner | 261/DIG. 56 |
| 1,547,296 | 7/1925 | Bullard | 261/44 |
| 2,214,273 | 9/1940 | Fish . | |
| 2,252,955 | 8/1941 | Woods | 261/62 |
| 2,407,334 | 9/1946 | Carlson | 261/44 |
| 2,777,678 | 1/1959 | Udale | 261/44 |
| 2,877,003 | 3/1959 | Goodridge et al. | 261/62 |
| 3,322,408 | 5/1967 | Stoltman | 261/44 F |
| 3,937,768 | 2/1976 | Bier et al. | 261/44 F |
| 4,327,041 | 4/1982 | Baltz et al. | 261/44 F |

FOREIGN PATENT DOCUMENTS

| | | | |
|---|---|---|---|
| 408007 | 3/1910 | France . | |
| 55-1420 | 1/1980 | Japan | 261/44 F |
| 55-64140 | 5/1980 | Japan | 261/DIG. 56 |
| 58608 | 11/1946 | Netherlands | 261/44 F |
| 16984 | 8/1906 | Norway | 261/53 |
| 567136 | 1/1945 | United Kingdom | 261/44 E |

*Primary Examiner*—Tim R. Miles

*Attorney, Agent, or Firm*—McCaleb, Lucas & Brugman

[57] ABSTRACT

A side draft carburetor is disclosed in which an eccentrically mounted throttle plate is provided with an aperture for passage of air therethrough and for movement of the throttle plate over a nozzle block interferingly projecting into the main air passageway of the carburetor. The nozzle block is equipped with a nozzle for introducing fuel into a venturi passageway formed between the nozzle block and a cam surface located about the rotational axis of the throttle plate; the cam surface moving with the throttle plate to vary the size and shape of the venturi passageway at the point of fuel introduction. This produces a finely atomized fuel mixture substantially centrally of the main air stream for optimum diffusion of the incoming fuel. In a modified version, the variable venturi passageway is effected by a flexible leaf spring responsive to a cam surface movable with the throttle plate to produce a passageway varying between convergent and divergent form as the throttle plate moves between closed and open positions. In both embodiments, the variable venturi passageway is restricted to a finite cross section of the carburetor's main intake air passageway defined by the effective aperture through the throttle plate, the nozzle block, the cam surface and laterally spaced barriers between the cam and the nozzle block.

9 Claims, 9 Drawing Figures

CARBURETOR

This invention relates to carburetors for internal combustion engines and more particularly to improvements in variable venturi carburetors.

In brief, this invention presents a novel and simplified structural combination productive of finely atomized and optimum air/fuel mixtures to an internal combustion engine and comprises a throttle plate movable across the carburetor's main intake air passageway and having an aperture matingly aligned with and movable over a stationary nozzle block projecting into the air intake passageway. This block serves to vary the opening of the throttle plate aperture and carries a fuel supply nozzle for introducing fuel substantially centrally into the main intake air stream. Cam means are provided about the throttle plate's rotational axis in alignment with the aperture therein and in spaced opposition to the fuel inlet nozzle. Spacing between the periphery of the cam means and the fuel nozzle effectuates a variably dimensioned passageway productive of a venturi vacuum opposite the discharge end of such nozzle. Barrier means laterally restrict the venturi passageway and extend between the cam means and the nozzle block. As a consequence, air flows past the fuel nozzle via said aperture in the throttle plate and the venturi passageway which are varied in direct relation to the positioning of the throttle plate across the main intake air stream. The result of this arrangement is to relate fuel introduction, effectuated by the variable venturi vacuum, directly to the throttle plate position and its control of the main air stream to provide optimum fuel economy and engine power. As with all variable venturi carburetors, a variable control means regulates the fuel supply to the inlet nozzle to meet variations in fuel demand.

A principal object of this invention is to provide an improved variable venturi carburetor productive of optimum air/fuel mixtures for internal combustion engines.

Another object of this invention is to provide a variable venturi carburetor wherein a restricted venturi passageway, provided at the point of fuel introduction, is altered in accordance with the carburetor's total air flow.

Another important object of this invention is to provide a variable venturi carburetor in which air flow past the fuel nozzle is regulated by a variable sized passageway communicating with a variable opening through the throttle plate.

Still another object of this invention is to provide a variable venturi carburetor in which fuel is introduced substantially centrally of the main intake air stream to promote better atomization and mixture thereof with intake air.

A still further object of this invention is to provide a variable venturi carburetor in which a venturi air stream past the fuel nozzle is controlled by a fixed aperture through the throttle plate which is varied by an obstruction extending into the intake air stream.

Having described this invention, the above and further objects, features and advantages thereof will appear from time to time from the following detailed description of preferred and modified embodiments thereof, illustrated in the accompanying drawings.

IN THE DRAWINGS

DESCRIPTION OF THE PREFERRED EMBODIMENT

Figure 3:
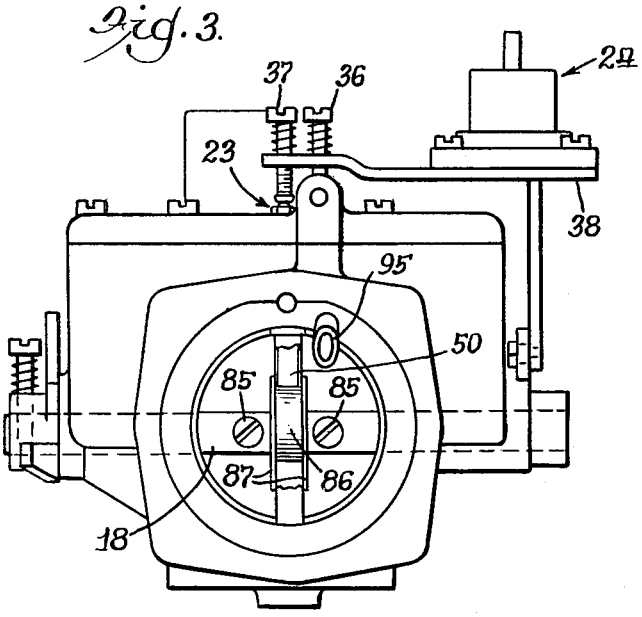
FIG. 3 is an end elvation of the left hand end thereof; showing the fuel metering linkage with throttle plate closed.
Figure 2:
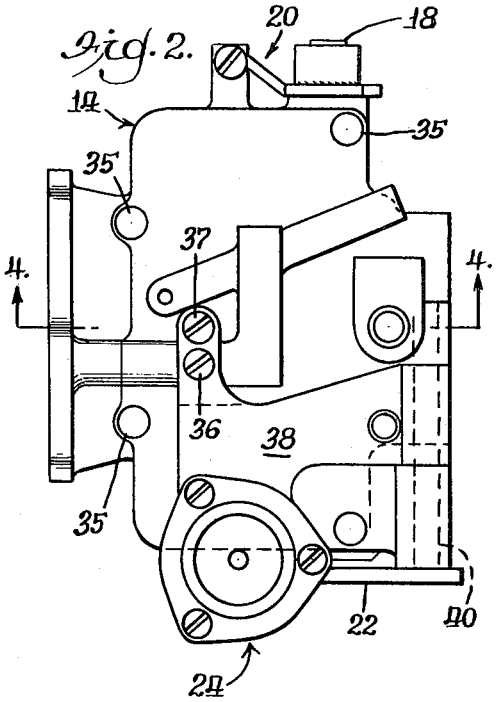
FIG. 2 is a top plan view thereof.

Turning now to the features of the illustrative embodiment of this invention shown in the drawings, FIGS. 1 through 8 set forth the features of a side draft carburetor incorporating this invention; although the concepts and teachings thereof are equally applicable to other style carburetors.

Figure 1:
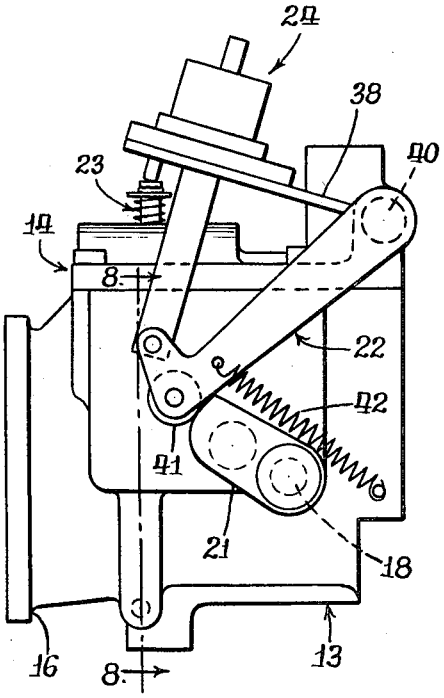
FIG. 1 is a side elevation of a carburetor embodying this invention oriented in operational position.
Figure 5:
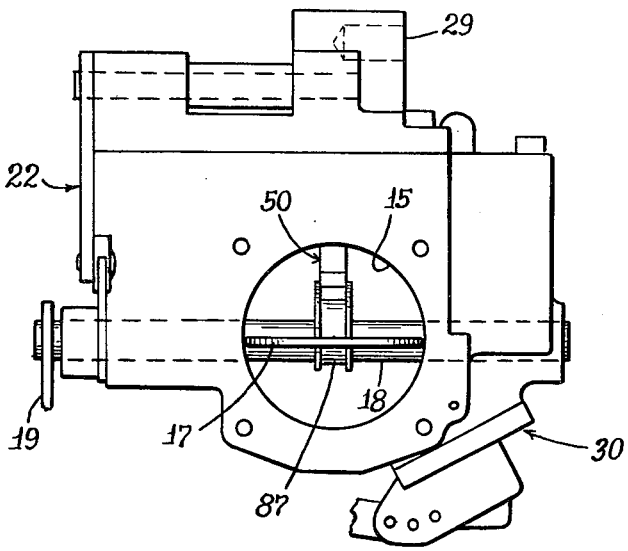
FIG. 5 is an end elevation of the right hand end thereof showing the throttle plate in open position.
Figure 6:
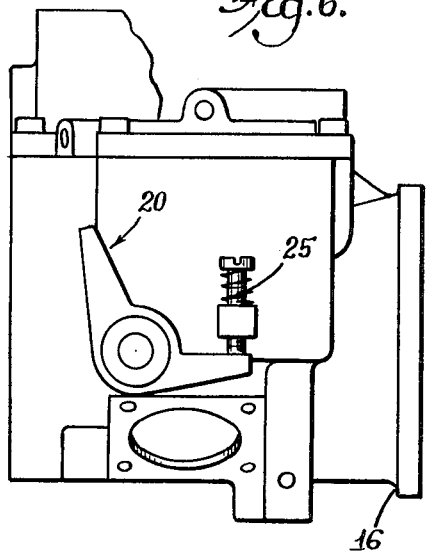
FIG. 6 is a side elevation of the left hand side of the carburetor with the accelerator pump cover removed.

Specifically, as shown in FIG. 1, the carburetor, designated generally at 12, comprises a cast metal body 13 having a removable cast metal cover 14 and formed with a central generally cylindrical opening 15 therethrough (see FIG. 5) for the passage of air to an associated engine; the inlet end of such passageway being distinguished by flanged portion 16 to which an air filter is attached in a conventional manner with the opposite end attaching to the engine's air manifold. The air passageway 15 is traversed by a generally circular throttle plate 17 (see FIG. 3) fixed to a throttle shaft 18 which extends through the body 13 and across the air passageway 15 for rotatably actuating the throttle plate in response to activation of an associated accelerator linkage system 19 (see FIG. 5) connected with a throttle travel adjustment arm 20 in a conventional fashion. As shown in FIGS. 1 and 6, the arm 20 is attached to one end of the throttle shaft 18 on one side of the carburetor while the opposite end thereof carries a cam member 21 for activating a metering linkage 22 operably associated with metering valve means 23 and a power enrichment assembly 24. Snd uitable adjustment screw means 25 operate against arm 20 to adjust the throttle plate idle position in particular.

Internally the body 13 has a fuel bowl 26 formed on the upper side thereof beneath cover means 14 for containing fuel and a fuel float system having an extended float lever arm 27. This lever arm engages the lower end of a fuel inlet control valve 28 operable to regulate the inlet of fuel to the fuel bowl via the fuel inlet 29 attached to a fuel supply tank (not shown) as by a conventional fuel line. Externally, the carburetor carries an accelerator pump assembly 30 which responds to an accelerator pedal and inkage in a conventional fashion.

Having set forth the generalities of the carburetor 12, particulars of the elemental portions thereof will now be described in greater detail.

Figure 7:
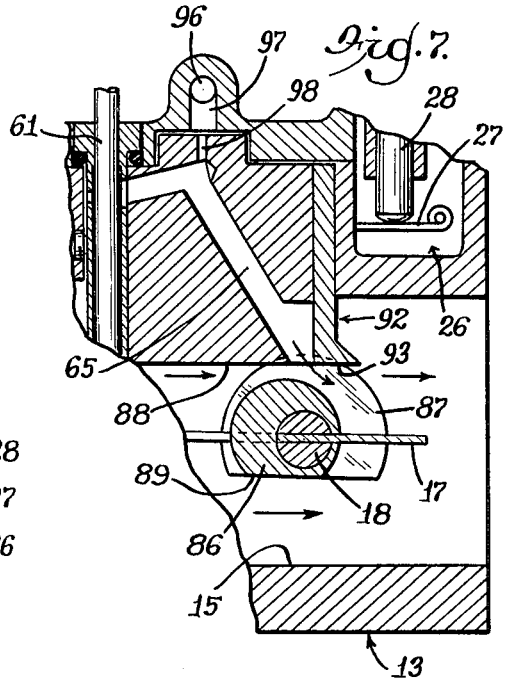
FIG. 7 is a partial cross sectional view, similar to FIG. 4, showing the throttle plate in open position.

Turning first to features of the body 13, it will be noted that the cover 14 therefor is affixed over the upper side of the body by a plurality of machine screws 35. Substantially centrally of the cover are an idle mix adjustment screw 36 and a metering valve adjustment screw 37, both carried by a movable plate means 38 which also supports the power enrichment diaphragm assembly 24 and is movable in response to activation of the fuel metering linkage 22. Basically, (see FIG. 1) linkage 22 is fixed to one end of a shaft means 40 that also pivotally supports the plate 38; shaft 40 being carried in suitable bored boss formations near one edge of the cover member 14. The opposite end of the linkage 22 carries a follower roller 41 engageable with the cam means 21 affixed to the outer end of the throttle shaft 18; the follower wheel being biased into engagement with the cam means 21 by means of a tension spring 42. The linkage 22 is pivotally joined at its outer end with an arm 43 extending downwardly from the plate 38 whereby pivotal activity of the link 22 serves to move plate 38 and adjustment screws 36 and 37 relative to the upper end of the metering valve assembly 23. It is to be noted that movement of linkage 22, in response to rotational movement of the throttle plate and throttle shaft, effectively depresses or raises the metering valve to regulate the flow of fuel to the carburetor in direct response to throttle plate positioning, as will be explained more fully presently. In the position illustrated in FIG. 1 of the drawings, the enrichment valve and fuel metering linkage are shown in a wide-open throttle position as depicted in FIG. 7 of the drawings.

Figure 4:
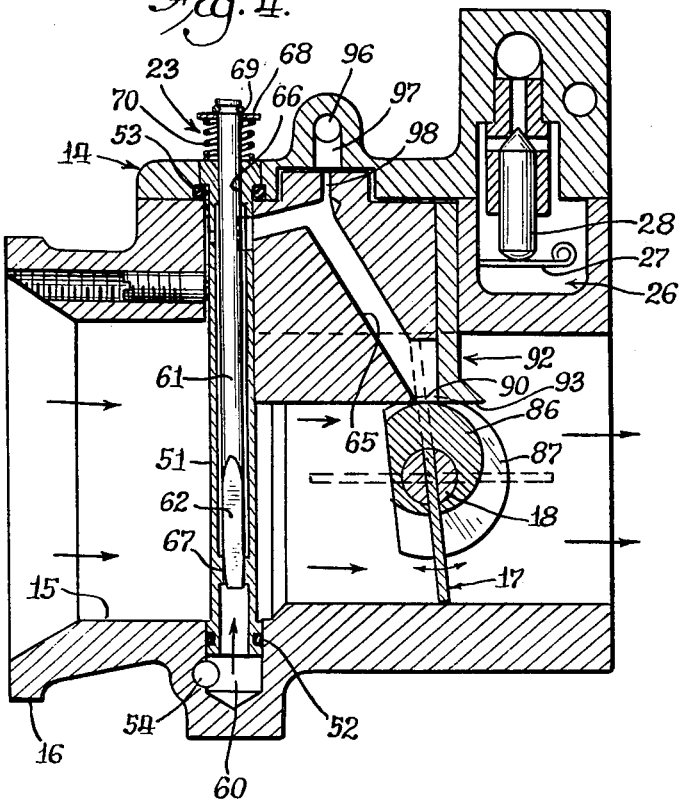
FIG. 4 is a cross sectional view taken substantially along vantage line 4—4 of FIG. 2 and looking in the direction of the arrows thereon and showing the throttle plate in closed position.
Figure 9:
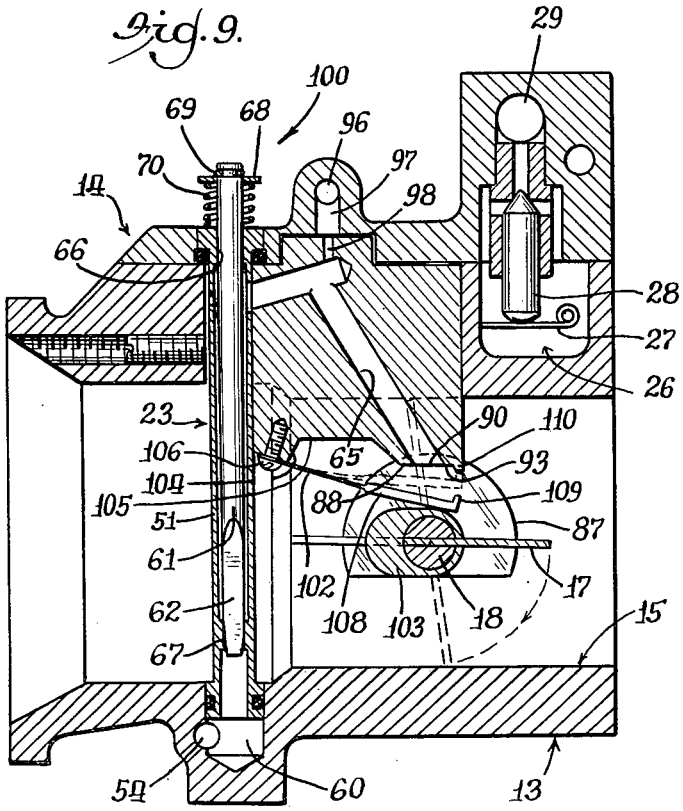
FIG. 9 is a cross sectional view similar to FIGS. 4 and 7, illustrating a modified form of the carburetor.

In addition to the cover 14, the carburetor body 13 is fitted internally with a fuel nozzle block 50 which depends interferingly into the interior of the air inlet passageway 15, extending partly across the diameter thereof as best shown in FIG. 4 of the drawings. This block 50 is inserted in a milled slot in the side wall of passageway 15 and is aligned with a tubular housing 51 that extends diametrically across passageway 15 to house the metering valve assembly 23, as best illustrated in FIG. 9 of the drawings.

Figure 8:
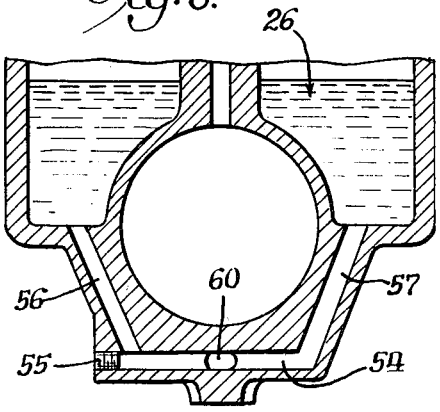
FIG. 8 is a partial cross sectional view taken substantially along vantage line 8—8 of FIG. 1 and looking in the direction of the arrows thereon to illustrate the fuel chamber and associated fuel supply passageways.

The tubular housing member is inserted in suitable aligned bores in the body 13 and is sealed by O-rings 52 and 53 with the body 13 and the cover 14, respectively. The lower end of the tubular member 51 communicates directly with a bored passageway system comprising a chamber end of the bore in which the tubular housing 51 fits, a cross bore 54, closed at one end by a threaded plug 55, and a pair of angularly disposed and upwardly extending bore passageways 56 and 57 leading from bore 54 to the bottom side of the fuel bowl 26 as shown in FIG. 8. In this fashion, fuel in the bowl 26 is gravitationally fed to the bore chamber 60 at the lower end of the metering valve assembly 23 which regulates flow from chamber 60 by means of a valve member 61 (see FIG. 9).

It will be observed that the valve 61 is generally cylindrical with a chisel shaped lower end portion 62 which is preferred to a normal conical pointed needle valve for better regulation of fuel flow. Further, the valve member 61 rides coaxially within the tubular member 51 with annular clearance therebetween providing passage of fuel upwardly past the lower end of the metering valve 61 and into a fuel supply passageway 65 in block 50 which leads to the bottom face of the nozzle block 50.

Valve 61 is guided in its vertical movements by bushing portions 66 and 67 formed internally of the tubular member 51 (see FIG. 4).

As best shown in FIG. 9 of the drawings, the extreme upper or outer end of the metering valve 61 carries a washer 68, held in place by a lock ring 69 engaged in a recess for that purpose formed near the outer end of the valve member. The washer abutts the upper end of a return spring means 70 which also engages the upper face of the cover 14 to normally bias the metering valve in an upward direction.

With this arrangement, depressing of the metering valve from its FIG. 9 position, serves to diminish the upflow of fuel past the lower chisel end 62 thereof and conversely, raising such valve tends to increase such flow. As noted previously, fuel is supplied to the chamber 60 at the lower end of the metering valve via the passageways 55, 56 and 57 which communicate directly with the fuel bowl chamber 26. As fuel flows past the lower end of the metering valve, it courses upwardly in the annular chamber between the tubular member 51 and metering valve member 61 and into the passageway means 65 through which it gravitates downwardly to the outlet or nozzle end leading to the main air stream of the carburetor coursing along air passageway means 15.

Inasmuch as the metering linkage 22 responds to movement of the cam member 21 and the throttle shaft, it will be appreciated that operation of the metering valve 61 (actuated by linkage 22) is also responsive to operation of the throttle plate 17 according to the fuel demand requirements of the engine being serviced by the carburetor.

Proper fuel level in the float chamber 26 is regulated in a conventional manner by the pivotal activity of the float (not shown) which actuates a float arm 27 for moving the fuel inlet valve 28 vertically to periodically open and close a passageway leading from the fuel supply connection 29.

From the description thus far, it will be appreciated by those of skill in the art that the features of the carburetor assembly 12 as hereinabove outlined are generally conventional and known in the art with the exception of the nozzle block 50. Attention is therefore directed to the features of the nozzle block 50 and its relationship to the carburetor air passageway 15 and throttle plate 17, wherein lie the principle and unique departures of the present invention over previous variable venturi carburetors known to this inventor.

With reference to FIG. 4, it will be recognized that the main air passageway 15 supplies incoming air through its bell shaped end or mouth portion bounded by the flange 16; air being regulated in its flow through the carburetor to the engine by means of the throttle plate 17 and its positioning across passageway 15 in a known fashion. It also will be noted that the presence of the nozzle block 50, depending into the air passageway interferes with the normal positioning of the throttle plate except for a peculiarity of structure, unique to this invention. Specifically, in order to permit the throttle plate to pass over the obstruction presented by the depending nozzle block, the throttle plate is notched out or cut away with a rectangular shaped opening closely conforming to the transverse or cross sectional area of the nozzle block. Thus, the slotted opening in the throttle plate clears the nozzle block as it moves from a fully open position (see FIG. 7) to a fully closed position illustrated in FIG. 4.

In order to accommodate the cut away area thus provided in the throttle plate and substantially balance the effective areas of the throttle plate on opposite sides of the rotational axis for the throttle shaft 18, the throttle plate is eccentrically mounted on the throttle shaft (see FIG. 3). As there shown, the plate 15 is fixed to the shaft by a pair of machine screws 85, 85 with the plate fitting into a milled out section of the shaft 18. This eccentric or off-center mounting of the throttle plate avoids the dangerous condition which would otherwise prevail if the effective areas of throttle plate on opposite sides of the shaft's throttle shaft's center line were unequal which would permit manifold vacuum to operate against such unbalanced areas and open the throttle plate in operation.

In addition to the cut away area in the throttle plate, a cam means 86 is mounted about the throttle shaft 18, aligned with the nozzle block 50 and the cut away or notched out area in the throttle plate, as shown best in FIGS. 3, 4 and 7 of the drawings. The cam means 86 is of a thickness substantially equal to that of the nozzle block 50 and operationally moves across and beneath the lower end of the nozzle block. At the opposite ends of the cam means and bounding the lateral limits of the cut away opening in the throttle plate are a pair of parallel planar barrier plates 87, 87 of like generally semi-circular formation as best shown in FIGS. 4 and 7. These plates are fixed to opposite ends of the cam member 86 and move therewith. It will be noted that the barrier plates 87 have a radius sufficient to overlap and extend beyond the lower edge 88 of the nozzle block throughout the range of movements of the throttle plate 17. Further, such barrier plates are concentric with the throttle plate shaft 18; although, as noted above, the same are cut away on one side, i.e. the upstream side as viewed in FIG. 4, to coincide with a corresponding edge formation 89 of the cam means 86.

Since the barrier means extend beyond the periphery of the cam means and overlap or extend beyond the bottom edge 88 of the nozzle block to straddle the same, it will be readily apparent that during rotation of the throttle plate, the barrier means or plates laterally confine the space between the curvilinear periphery of the cam means and end face of the nozzle block.

It also will be observed that the cam means 86 is disposed directly opposite the nozzle or outlet opening 90 of the fuel supply passageway 65 in the nozzle block so that as the throttle plate is rotated to regulate the flow of air through the main air passageway 15, the distance between the periphery of the cam means 86 and the lower face 88 of the nozzle block 50 is varied in accordance with the periphery of the cam means. Thus, a variable venturi passageway is provided directly opposite the point of fuel introduction. Such venturi passageway changes in accordance with the positioning of the throttle plate across the passageway 15, varying from a convergent substantially fully closed formation as shown in FIG. 4 when the throttle plate is in a closed position, to an open divergent passageway when plate 17 is in a fully open position, as illustrated in FIG. 7. In between those two positions, the venturi passageway varies between convergent and divergent configurations in accordance with the positioning of the throttle plate and the cam means.

It is important to note that in the formation of the venturi passageway between the cam means the lower edge of the nozzle block, the nozzle block itself enters into the regulation of air flow by its cooperating interfitting with the notch or cut away area of the throttle plate; substantially cutting off air flow through such cut away in the closed position of the throttle plate as shown in FIG. 4, for example. Thus, once the throttle plate's cut away area moves over the depending nozzle block, the nozzle block itself gradually closes off the cut away area as the throttle plate approaches a fully closed position across the main air passageway of the carburetor. Conversely, as the throttle plate moves toward a fully open position, illustrated in FIG. 7, the nozzle block operatively increases the effective size of the cut away opening through the throttle plate, thereby actively participating in the control of air flow through the venturi passageway and past the fuel inlet nozzle opening 90.

Of equal importance in this combination is the presence of the barrier plates 87 which serve to laterally restrict the size of the venturi passageway, thereby localizing the vacuum provided by the venturi action at the point of fuel introduction. If one were to consider for example, the operation of the carburetor, at one-half throttle position, without the flange barriers 87, the fuel orifice 90 at the end of passageway 65 would be subjected to the full intake manifold vacuum of the engine instead of the vacuum created by the venturi passageway. Thus, the cooperation of the nozzle block, the throttle plate and the cam means plus the lateral barrier plates serves to control the air flow through the venturi passageway and substantially isolate the venturi vacuum from the manifold vacuum of the engine. Such an arrangement provides improved and more responsive control of fuel introduction. It also is to be noted that the location of the nozzle is such that fuel introduction occurs generally at the point of highest air velocity in the venturi passageway.

Of similar importance is the fact that the air fuel mixture exiting from the venturi passageway is introduced generally centrally into the air stream within passageway 15. By so introducing the air fuel mixture centrally of the air flow past the throttle plate, fine atomization of the fuel mixture is brought about before the same is introduced to the engine with a minimum formation of fuel droplets along the walls of the air passageway 15. While the problem of fuel condensation or coalescence along the walls of the main air stream passageway 15 is generally avoided by the described arrangement, there is some tendency for the fuel to bead and coalesce along the face or periphery of the cam means 86 due to vortex currents adjacent the downstream side of nozzle block 50. This tendency is materially repressed and avoided, however, by providing a diffuser on the downstream side of the fuel inlet passageway or nozzle 90 as by means of a diffuser insert 92.

In the illustrated embodiment, the insert member is formed with a planar lower surface 93 forming a sharp chisel corner at the fuel nozzle outlet 90. This shears the fuel air mix and guides the same generally parallel to the walls of passageway 15. This action enhances mixture of the fuel air mix and intake air stream within passageway 15 downstream of block 50, thereby preventing condensation of droplets along the surface of cam means 86 and throwing the fuel air mix from the venturi generally into the central zone of the intake air flow along passageway 15.

While the member 92 is herein illustrated as an insert which cooperates with the nozzle block and is fitted into the milled slot formed to receive the block 50, such member 90 may also be an integral portion of the nozzle block to promote ease of manufacture and assembly.

In order to prevent fuel syphoning from bowl 26 and to modulate the suction provided by the venturi air stream at the point of fuel introduction, particularly at low operating and idling speeds, a conventional air bleed system is provided comprising, air scoop means 95 (see FIG. 3) upstream of the tubular member 51 which communicates with an internal passageway system including an air bleed passageway 96 formed in the cover member 14 and passageways 97 and 98 leading to the fuel passageway 65. Thus, auxiliary air is bled into the fuel stream in passageway 65 prior to its introduction to the main air passageway of the carburetor; modulating the high venturi fuel suction as desired, particularly at intermediate to closed throttle conditions.

It will be noted that as the plate 17 reaches full open position illustrated in FIG. 7 of the drawings, flow of the fuel air mixture exiting from the venturi passageway is not entirely central of the main air passageway 15 which is desirable to prevent fuel from forming droplets along the surface of the passageway 15. However, the compromised positioning of the venturi air flow illustrated, permits generally centralized flow of the fuel air stream particularly at smaller throttle openings which is the prevalent operating mode of the carburetor whereof the velocity of air flow and venturi suction is greatest and manifold vacuum is highest.

Having described the preferred embodiment of this invention, reference is now made to FIG. 9 of the drawings whereat a modified carburetor 100 is illustrated, as will now be described.

The features of the modified carburetor 100 of my invention are set forth and fully understandable from FIG. 9 of the drawings from which it will be recognized that modified changes therein center about a modified nozzle block 101; a flexible leaf member 102 disposed beneath the nozzle block and a modified cam means 103 for effectively varying the positioning of the leaf member to form a variable venturi passageway opposite the discharge end or nozzle 90 of the fuel supply passageway means 65. The other parts and portions of the modified carburetor 100 as illustrated in FIG. 9 correspond to like parts in the carburetor assembly 12 and will not be detailed in the description to follow.

Specifically, the modified nozzle block 101 is a unified member insertable in the milled slot or opening formed in the walls of the air passageway means 15 for the carburetor body 13. As in the first described assembly, block 101 depends interferingly into the cylindrical interior of passageway 15 and is cleared by a cut away area or opening in the throttle plate 17. However, it will be noted that the lower face of the modified nozzle block 101 is undercut between an area just slightly upstream of the fuel nozzle opening 90 and a mounting block portion 104; such undercut area being designated by numeral 105. The mounting block 104 effectively depends from one end of the cut away 105 and is provided with a sloping lower end to accommodate a mounting screw or machine bolt 106 for purposes of affixing one end of the leaf member 102 thereto.

The purpose of the undercut area 105 is to provide an air passageway around the leaf member 102 which extends between the mounting block 104 and the modified cam means 103 mounted about the axis of the throttle shaft 18. Otherwise, such leaf member would effectively block off the entry to the venturi passageway as described for the preferred carburetor assembly 12. As in assembly 12, the throttle plate 17 is provided with a cut away area which in this case not only accommodates passage of the lower end of the nozzle block 101 therethrough, but also accommodates the passage of the leaf member 102 as the throttle plate is rotated from its full lined open position, illustrated in FIG. 9, to a closed throttle position indicated in dotted lines in that figure.

As noted, the leaf member 102 is attached to the mounting block 104 in cantilever fashion in the illustrative embodiment of FIG. 9 by the machine screw 106. As mentioned, the leaf member is aligned with the slotted opening in the throttle plate 17 with the free end thereof engaging the periphery of the cam means 103 to ride over the same in response to rotational movement of the throttle plate and shaft 18. It will be readily appreciated that as the cam means 103 moves from its full lined position illustrated in FIG. 9, toward the closed throttle position, the leaf member, which is of spring steel or the like, flexes upwardly toward the nozzle opening 90 of the fuel inlet passageway 65, varying the throat of the venturi opening or passageway formed between the upper side of the leaf member 102 and the opposing surface portions 88 and 93 of the nozzle block adjacent the nozzle opening 90.

The outer end of the leaf member 102 is preferably fitted with an enlarged member 108 which is press fitted over the body of the leaf member to engage the cam member; the same preferably being made of low friction plastic material having a tendency to reduce ice formation and coalescence of fuel thereon.

The outer end of member 108 is distinguished by an up-turned step 109 opposed by a corresponding step 110 depending from the lower face 93 of the nozzle block. These two steps cooperate in operation to shear the fuel and air mixture exiting from the venturi passageway, thereby breaking up the fuel droplets to promote better intermingling and vaporization mixture of fuel and air. While a corresponding step may be utilized in the first described structure 12 illustrated in FIG. 4 to depend from the nozzle block if desired, the modified form of FIG. 9 permits incorporating one or more such steps on the leaf member 108 to assist in this shearing activity. It also is to be noted that the leaf member and particularly the member 108 thereon, assists materially in deflecting and directing the fuel air mixture exiting from the venturi toward the central zone of the main air stream flowing through air passageway 15.

Due to the indirect affect of the cam means 103 in the formation of the shape of the venturi passageway in carburetor 100, as opposed to the direct action of cam 87 in carburetor 12, it is possible in the modified structure of FIG. 9 to vary the cam configuration and accordingly regulate and vary the contour of the venturi passageway as desired. Such variations include the provision of the step members 109 and 110 as previously described and gradual or immediate change in the venturi passageway.

While the modified structure FIG. 9 has been illustrated and described as utilizing a cantilever mounted leaf member 102, it is within the contemplation of this invention that the leaf member may be hingedly mounted at one end as opposed to the fixed cantilever mounting illustrated; utilizing a small helical spring or the like to maintain the leaf element in contact with the cam 103 at all times.

It will be understood that the modified carburetor structure of FIG. 9 maintains the basic advantages of carburetor 12 first hereinabove described in that it provides a convergent venturi passageway at small throttle openings, which aids in modulating metering heads that are typically too high under those operating conditions as well as providing a divergent passageway at large throttle openings to enhance metering heads which are normally lower than desired at open throttle conditions. Further, as noted, within general limitations, it is possible to vary the contour of the venturi passageway as desired to promote better atomization of fuel droplets while maintaining a directional exit for the fuel/air mix flowing from the venturi passageway to maintain the same away from the walls of the main air passageway 15. This structure also avoids fuel droplet formation on the cam means 103 as well. In addition, while the leaf member 102 is shown in FIG. 9 as mounted at a particular depending angle, such mounting angle may be varied as desired in order to direct the fuel air stream move toward or away from the center of the main air passageway 15 as desired. In addition, the point of discharge of the air/fuel mix may be shifted downstream from the center line of the throttle shaft by extending the leaf member 102 past the throttle shaft to further reduce the likelihood of the expanding mixture's from contact with the cam 103 and barrier flange members 87. These advantages are not as fully achievable with the structure heretofore described in conjunction with the preferred carburetor 12 illustrated in FIGS. 1 through 8 of the drawings.

Thus, with the modified structure 100, greater freedom of choice is obtained, particularly in choosing the contour of the cam member 103 since its shape no longer has any direct influence on the behavior of the air flow through the venturi passageway. As such, cam contours which provide a much faster or slower increase in the size of the variable venturi passageway are possible in the modified structure of carburetor 100.

From the foregoing, it is believed those familiar with the art will readily recognize and appreciate the novel advancement of the present invention over previous variable venturi carburetors and will understand that while the invention has been described in conjunction with a preferred and modified form thereof, illustrated in the accompanying drawings, the same is susceptible to variation, modification and substitution of equivalents without departing from the spirit and scope of the invention which is intended to be unlimited by the foregoing description except as may appear in the following appended claims.

The embodiments of the invention in which an exclusive property or privilege is claimed are defined as follows:

1. A carburetor for internal combustion engines, comprising a main body having intake air passageway means of generally circular cross-section communication between atmospheric air and the intake manifold of the engine, a single planar throttle plate configured to fit the cross-section of said passageway means and mounted for limited rotational movement about an axis transverse of said passageway means to operably control the flow of air therethrough; a nozzle block extending into said passageway means in interfering relation with the rotational path of said throttle plate and having fuel introducing means at an outer end face thereof for introducing fuel substantially centrally into the stream of air flowing through said passageway means; said throttle plate having a cut away area extending inwardly of its periphery for registering reception of said nozzle block whereby to afford movement of said throttle plate over said block; and means cooperating with said nozzle block and moveable coaxially with said throttle plate and toward and away from said outer end face of said block to effectuate a variable size, convergent/divergent venturi passageway therebetween; said venturi passageway having its zone of maximum air velocity generally opposite the point of fuel introduction from said fuel introducing means with the vacuum effect of said venturi passageway being isolated from and independent of the engine's manifold vacuum and varying directly with the positioning of said throttle plate across said passageway means throughout said plate's range of movement.

2. The combination of claim 1 and a variable fuel supply means reactive to movement of the throttle plate for varying the supply of fuel to said fuel introducing means in accordance with the size of said variable venturi passageway.

3. The combination of claim 1 wherein said plate is mounted eccentrically on said axis so that the effective areas of said plate subject to the engines manifold vacuum on opposite sides of said axis are balanced.

4. The combination of claim 1 wherein said cut-away area supplies inlet air to said venturi passageway and said nozzle block cooperates with said cut-away area to vary its effective size between fully open and fully closed to accordingly vary the supply of said inlet air as said plate moves over said block.

5. The combination of claim 1 wherein said means cooperating with said block comprises cam means coaxially rotatable with said plate and presenting a periphery aligned with said block which is movable toward and away from the fuel introducing means thereof whereby to vary the size of the venturi passageway.

6. The combination of claim 5 wherein said means cooperating with said block comprises parallel barrier means extending between and overlapping axial ends of said cam means and opposite sides of said nozzle block to define laterial limits for said venturi passageway; said barrier means being moveable coaxially with said plate and cam means.

7. A carburetor having a body provided with a main air intake passageway means communicating between atmospheric air and an internal combustion engine, a throttle plate rotatably mounted for movement on an axis transverse to said passageway means and operable to control the flow of air therethrough, a nozzle block extending into said passageway means and having means for introducing fuel thereinto; and means moveable with said plate and cooperating with said block to effectuate a variable venturi passageway adjacent said fuel introducing means comprising a leaf element extending between said nozzle block and cam means mounted for movement with said plate about said axis; said leaf element reacting to movements of said cam means to vary the size of said venturi passageway with the vacuum effect created by said venturi passageway varying directly with the positioning of said plate across said passageway means.

8. The combination of claim 7 and step means adjacent the downstream of said block and leaf element for directing the air/fuel mixture exiting from said venturi passageway to a zone remote from said block and substantially centrally of the air stream in said air passageway means.

9. The combination of claim 7, wherein said means cooperating with said block comprises parallel barrier means between axial ends of said cam means and opposite sides of said nozzle block to define laterial limits for said venturi passageway; said barrier means being coaxially moveable with said plate and cam means.

* * * * *